United States Patent [19]

Lehman

[11] 4,188,213

[45] Feb. 12, 1980

[54] COLOR CORRECTED PRINTING SYSTEM

[75] Inventor: Richard F. Lehman, Fairport, N.Y.

[73] Assignee: Xerox Corporation, Stamford, Conn.

[21] Appl. No.: 563,021

[22] Filed: Mar. 28, 1975

Related U.S. Application Data

[62] Division of Ser. No. 421,387, Dec. 3, 1973, Pat. No. 3,902,801.

[51] Int. Cl.[2] ..... G03G 13/01

[52] U.S. Cl. ..... 430/43; 355/4; 430/45

[58] Field of Search ..... 96/1.2, 1.4; 355/4

[56] References Cited

U.S. PATENT DOCUMENTS

| | | | |
|---|---|---|---|
| 2,547,706 | 4/1951 | Huebner | 96/1.2 UX |
| 2,808,328 | 10/1957 | Jacob | 96/1.2 |
| 2,986,466 | 5/1961 | Kaprelian | 355/4 X |
| 3,043,686 | 7/1962 | Bickmore | 96/5 X |
| 3,057,720 | 10/1962 | Hayford et al. | 96/1.2 |
| 3,178,281 | 4/1965 | Jarvis | 96/1.2 |
| 3,420,662 | 1/1969 | Meyer et al. | 96/1.2 X |
| 3,612,677 | 10/1971 | Landgon et al. | 355/4 |
| 3,615,391 | 10/1971 | Honjo et al. | 96/1.2 |
| 3,672,887 | 6/1962 | Matsumoto et al. | 96/1.2 |
| 3,702,483 | 11/1972 | Fantuzzo | 96/1.2 UX |
| 3,729,311 | 4/1973 | Langdon | 96/1.2 |
| 3,799,774 | 3/1974 | Matsumoto | 96/1.2 |
| 3,841,751 | 10/1974 | Drangelis et al. | 355/4 |
| 3,844,783 | 10/1974 | Matsumoto et al. | 96/1.2 |
| 3,910,789 | 10/1975 | Hastwell | 96/1.2 |
| 3,918,970 | 11/1975 | Auzai | 96/1.2 |

*Primary Examiner*—John D. Welsh

*Attorney, Agent, or Firm*—H. Fleischer; C. A. Green; J. J. Ralabate

[57] ABSTRACT

A color process in which color copies of an original document containing color information are reproduced. In this process, successive single color electrostatic latent images are recorded on an image bearing member. Each successive single color electrostatic image is developed with particles containing a predetermined colorant therein. These particles are transferred from the single color electrostatic latent images in a prescribed sequence. The sequence of transfer is such that the colorant of each successive layer of transferred particles corrects for the impurities contained in the colorant of the previously transferred layer of particles. The final color rendition of the copy is, thereby, color corrected so as to substantially approximate that of the original document.

3 Claims, 4 Drawing Figures

COLOR CORRECTED PRINTING SYSTEM

This is a division of application Ser. No. 421,387, filed Dec. 3, 1973, now U.S. Pat. No. 3,902,801.

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns a transfer apparatus employed therein which produces a color corrected copy from an original document.

In the process of electrophotographic printing, a photoconductive surface is uniformly charged and exposed to a light image of the original document. Exposure of the photoconductive surface creates an electrostatic latent image corresponding to the original document. Toner particles are then electrostatically attracted to the latent image to render it viewable. Subsequently, the toner powder image is transferred to a sheet of support material and permanently affixed thereto to produce a copy of the original document. The foregoing process is described in detail in U.S. Pat. No. 2,297,691 issued to Carlson in 1942.

Multi-color electrophotographic printing is substantially identical to the heretofore discussed process of black and white printing with the following distinctions. Rather than forming a total light image of the original, the light image is filtered producing a single color light image which is a partial light image of the original document. The foregoing single color light image exposes the photoconductive surface to create a single color electrostatic latent image. The single color electrostatic latent image is developed with toner particles of a color complementary to the single color light image. The single color toner powder image is then transferred from the electrostatic latent image to a sheet of support material. This process is repeated a plurality of cycles with differently colored light images and the respective complementary colored toner particles. Each single color toner powder image is transferred to the sheet of support material in superimposed registration with the prior toner powder image. This creates a composite multi-layered toner powder image on the sheet of support material. Thereafter, this composite multi-layered toner powder image is permanently affixed to the sheet of support material to create a color copy corresponding to the colored original document.

The fidelity of the color is limited by the imperfect nature of the spectral transmittance of the toner particles. Ideal toner particles perfectly absorb over a preselected spectral region and perfectly transmit over the remaining spectral region. For example, ideal cyan will perfectly absorb red light and perfectly transmit blue and green light. Similarly, ideal magenta will perfectly absorb green light and transmit both blue and red light. Finally, ideal yellow will absorb perfectly in the blue region while transmitting both red and green light. However, real materials differ from these ideal colorants by exhibiting unwanted absorption in regions where they should be perfectly transmitting. Typical cyan toner particles absorb not only red but also some green thus, cyan toner particles contain some magenta impurities therein. Similarly, typical magenta toner particles absorb some blue and therefore contain some yellow impurities therein. It should be noted that the yellow toner particles are substantially pure. It is therefore apparent that a combination of the foregoing toner particles will produce not only the desired resultant color but a color produced from the impurities which is an undesired effect. This will result in the colors of the copy differing from that of the original. Compensation for the impure spectral characteristics of the toner particles is termed color correction. A set of ideal toner particles would require no color correction.

Thus, it is a primary object of the present invention to improve the method and apparatus employed in reproducing color copies so as to correct for the impurities of colors employed therein.

SUMMARY OF THE INVENTION

Briefly stated and in accordance with the present invention there is provided an electrophotographic printing machine for creating color corrected copies from a color original document.

This is achieved, in the present instance, by an electrophotographic printing machine employing means for charging a photoconductive member to a substantially uniform potential. Means are provided for exposing the charged photoconductive member to successive single color light images. This records successive single color electrostatic latent images on the photoconductive member. A plurality of developing units are arranged to act on the photoconductive member. Each developer unit brings into operative communication with the photoconductive member toner particles containing a predetermined colorant. The colorant of each of the toner particles corresponds to the single color light image employed to record the single color electrostatic latent image on the photoconductive member. In this manner, successive single color electrostatic latent images are rendered visible with toner particles having the corresponding colorant therein. In addition, means are provided for transferring toner particles from successive single color electrostatic latent images to a sheet of support material. Each successive layer of toner particles transferred to the sheet of support material contains a colorant corresponding in color to the color of the impurity contained in the previously transferred layer of toner particles. Successive layers of toner particles are transferred in superimposed registration with one another. Hence, each successive transferred layer of toner particles corrects for the impurity contained in the colorant of the previously transferred layer of toner particles. This produces a combination of toner particles substantially approximating the ideal color.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF INVENTION

Figure 1:
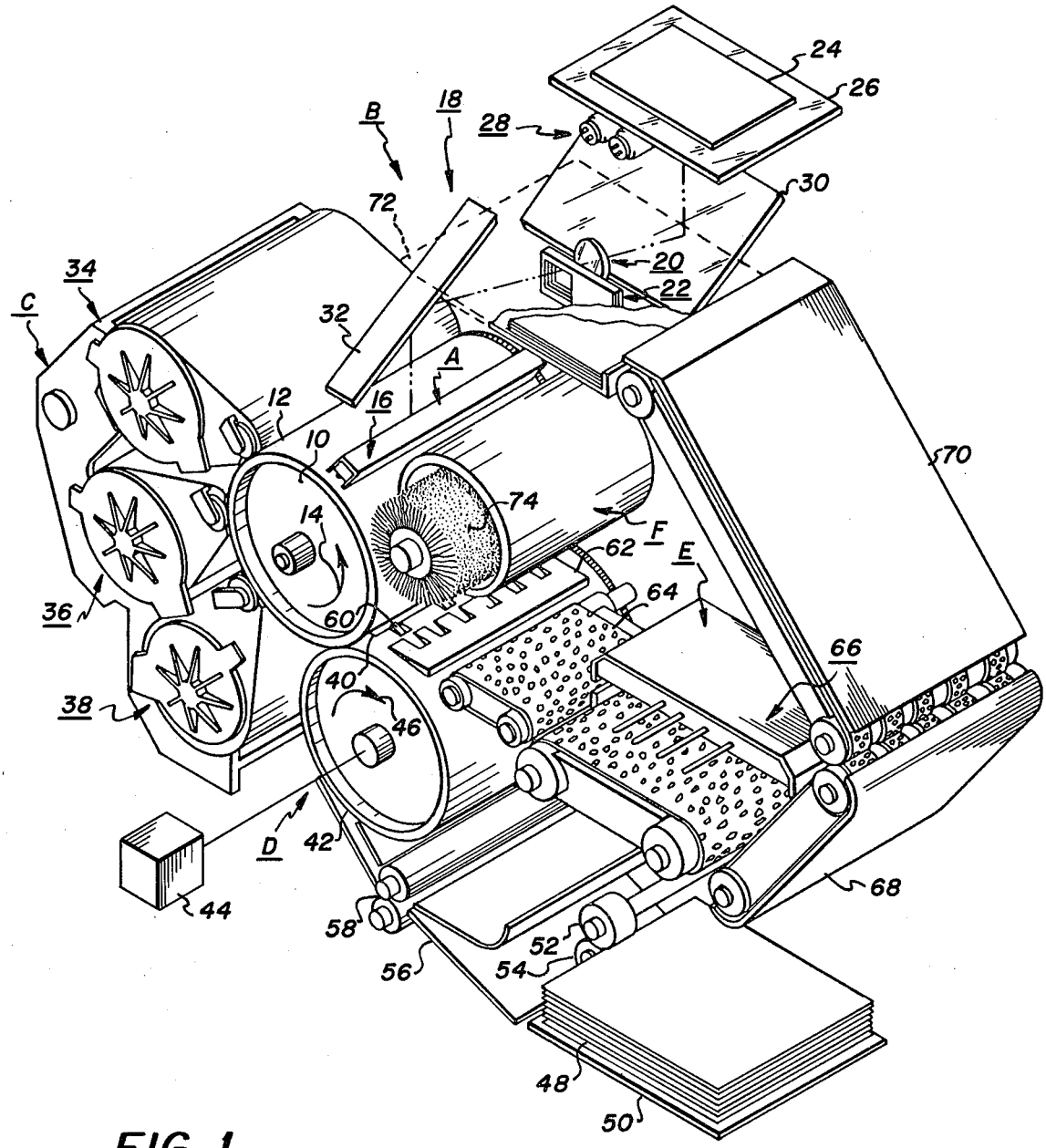
FIG. 1 is a schematic perspective view of a multicolor electrophotographic printing machine incorporating the features of the present invention therein.

For a general understanding of the disclosed multicolor electrophotographic printing machine in which the present invention may be incorporated, continued reference is had to the drawings wherein like reference numerals have been used throughout to designate like elements. FIG. 1 schematically illustrates the various components of a printing machine for producing color corrected copies from a colored original document. Although the transfer apparatus of the present invention is particularly well adapted for use in an electrophotographic printing machine, it should become evident from the following discussion that it is equally well suited for use in a wide variety of electrostatographic printing machines and is not necessarily limited in its application to the particular embodiment shown herein.

The process employed in the multi-color electrophotographic printing machine depicted in FIG. 1 is a subtractive color-to-color reproducing process wherein toner particles having colorants containing the subtractive primaries cyan, magenta and yellow are employed to provide a wide range of colors found in the original document on the color copy. The first step in producing a color copy is to ascertain the color composition of the original subject matter and to record this information on an image bearing member. The color original document is optically scanned a number of times to formulate successive electrostatic latent images on the image bearing member. Each light image is passed through a color filter to form a color separated electrostatic latent image. The electrostatic latent image created by passing the light image through a filter is developed by toner particles containing colorants complementary thereto. Areas of relatively high charge density on the image bearing member indicate the absence of the filtered light, while areas of relatively low charge density on the image bearing member indicate the presence of the filtered light in the colored original. For example, the electrostatic latent image formed by passing the light image through a green filter will record magentas as areas of relatively high charge density on the image bearing member while the green light rays will cause the charge density on the image bearing member to be reduced to an ineffective development level. The magentas are then made visible by applying toner particles containing a green absorbing, i.e. magenta, colorant to the electrostatic latent image recorded on the image bearing member. Similarly, a blue separation is developed with toner particles containing a yellow pigment while a red separation is developed with toner particles containing a cyan colorant. The three developer color separated toner powder images are then brought together, in registration, on a sheet of final support material to produce a multi-color copy.

Turning now to FIG. 1, the detailed structural configuration of the electrophotographic printing machine employing the process hereinbefore described will now be discussed. The electrophotographic printing machine utilizes an image bearing member having a drum 10 with a photoconductive surface 12 secured to and entrained about the exterior circumferential surface thereof. Preferably, photoconductive surface 12 is made from a material having a relatively panchromatic response to white light. One type of suitable photoconductive material is disclosed in U.S. Pat. No. 3,655,377 issued to Sechak in 1972. Drum 10 is mounted rotatably within the printing machine on the frame thereof (not shown). A series of processing stations are disposed such that as drum 10 rotates in the direction of arrow 14, photoconductive surface 12 passes sequentially therethrough. Drum 10 is driven at a predetermined speed relative to the other machine operating mechanisms by a drive motor (not shown). A timing disc is mounted in the region of one end of drum 10 and is adapted to trigger the logic circuitry of the printing machine. This coordinates the various machine operations with one another to produce the proper sequence of events at the various processing stations.

Initially, drum 10 moves photoconductive surface 12 through charging station A. A corona generating device, indicated generally at 16, is disposed at charging station A. Corona generating device 16 extends in a generally longitudinal direction transversely across photoconductive surface 12. This readily enables corona generating device 16 to charge photoconductive surface 12 to a relatively high substantially uniform potential. Preferably, corona generating device 16 is of the type described in U.S. Pat. No. 2,778,946 issued to Mayo in 1957.

Thereafter, drum 10 is rotated to exposure station B. Exposure station B includes thereat an optical system generally designated by the reference numeral 18. Optical system 18 includes a moving lens system, generally designated by the reference numeral 20, and a color filter shown generally at 22. An original document 24 is disposed upon transparent viewing platen 26. Scan lamps 28 are disposed beneath transparent platen 26 to illuminate original document 24 positioned thereon. Lamps 28, lens 20 and filter 22 move in a timed relation with drum 10 to scan successive incremental areas of original document 24 disposed upon platen 26. Mirror 30 reflects light rays reflected from original document 24 through lens 20. After passing through lens 20, the light rays are transmitted through filter 22, i.e. a selected color separation filter inserted into the path of the light rays. Thereafter, the light rays are reflected from a second mirror 32 onto photoconductive surface 12 of drum 10 to selectively dissipate the charge thereon in the irradiated areas forming a single color electrostatic latent image thereon. As previously indicated, the appropriate color filter operates on the light rays passing through lens 20 to record an electrostatic latent image on photoconductive surface 12 corresponding to a preselected spectral region of the electromagnetic wave spectrum, hereinafter referred to as a single color electrostatic latent image. Preferably, filter mechanism 22 includes three filters, a blue filter, a red filter and a green filter. Each of the filters is associated with its respective toner particles and the associate colorant, i.e. the complement of the color thereof to produce a subtractive system. By way of example, a green filtered light image is developed with toner particles containing a magenta colorant, a blue filtered light image is developed with toner particles containing a yellow colorant, and a red filtered light image is developed with toner particles containing a cyan colorant.

With continued reference to FIG. 1, after exposure, drum 10 rotates the single color latent electrostatic latent image recorded on photoconductive surface 12 to development station C. Development station C includes three developer units, generally indicated by the reference numerals 34, 36 and 38, respectively. Preferably, the developer units are all of a type generally referred to as magnetic brush developer units. A typical magnetic brush developer unit employs a magnetizable developer mix of carrier granules and toner particles. The developer mix is continually brought through a directional flux field to form a brush thereof. Each developer unit includes a developer roll electrically biased to the appropriate potential such that the toner particles are attracted from the carrier granules to the areas of photoconductive surface 12 having a greater charge thereon, i.e. the single color electrostatic latent image. The single color electrostatic latent image recorded on photoconductive surface 12 is developed by bringing the brush of developer mix into contact therewith. Each of the respective developer units contains toner particles having discrete colorants therein corresponding to the complement of the spectral region of the wave length of light transmitted through filter 22. As hereinbefore indicated, a green filtered electrostatic latent image is rendered visible by depositing toner particles having a magenta colorant therein adapted to absorb green. Similarly, blue and red electrostatic latent images are developed with toner particles having a yellow colorant and toner particles having a cyan colorant therein, respectively.

Drum 10 is, next, rotated to transfer station D where the toner powder image adhering electrostatically to photoconductive surface 12 is transferred to a sheet of support material 40. Support material 40 may be plain paper or a sheet of thermoplastic material, amongst others. Transfer station D includes a transfer member, designated generally by the reference numeral 42. Transfer member 42 is a roll adapted to recirculate support material 40 and is electrically biased to the appropriate voltage by a variable power supply 44. This potential is of sufficient magnitude and polarity to attract electrostatically the toner particles from the electrostatic latent image recorded on photoconductive surface 12 to support material 40. Transfer roll 42 rotates in synchronism with photoconductive surface 12. Inasmuch as support material 40 is secured releasably thereon for movement in the recirculated path therewith, successive toner powder images may be transferred thereto into superimposed registration with one another. In this case, transfer roll 42 rotates in the direction of arrow 46 at substantially the same angular velocity as drum 10. Transfer member 42 will be described hereinafter in greater detail with reference to FIG. 2.

Support material 40 is advanced from a stack 48 thereof. Stack 48 is disposed upon tray 50. Feed roll 52, in operative communication with retard roll 54, advances and separates the uppermost sheet from stack 48 disposed upon tray 50. The advancing sheet moves into a chute 56 which directs it into the nip between register rolls 58. Thereafter, gripper fingers, indicated generally at 60, mounted on transfer roll 42 secure releasably thereon support material 40 for movement therewith in a recirculated path. After a plurality of toner powder images have been transferred to support material 40, gripper fingers 60 release support material 40 and space it from transfer roll 42. Stripper bar 62 is then interposed therebetween to separate support material 40 from transfer roll 42. Thereafter, endless belt conveyor 64 advances support material 40 to fixing station E. At fixing station E, a fuser, indicated generally at 66, generates sufficient heat to permanently affix the multi-layered toner powder image to support material 40. Moreover, the toner powder layers are rendered substantially transparent to act as filters. In this manner, the light rays are transmitted through the respective toner powder layers to the support material and then reflected back therefrom to the eye of the observer. The observer then sees the copy in the colors substantially corresponding to that of the original document. One type of suitable fuser is described in U.S. Pat. No. 3,498,592 issued to Moser et al. in 1970. After the fusing process, support material 40 is advanced by endless belt conveyors 68 and 70 to catch tray 72 for subsequent removal therefrom by the machine operator.

Thereafter, drum 10 is advanced to cleaning station F. Although a preponderance of the toner particles are transferred to support material 40, invariably some residual toner particles remain on photoconductive surface 12 after the transfer of the toner powder image therefrom. These residual toner particles are removed from photoconductive surface 12 as it passes through cleaning station F. Here, the residual toner particles are initially brought under the influence of a cleaning corona generating device (not shown) adapted to neutralize the electrostatic charge remaining thereon. The neutralized toner particles are then removed from photoconductive surface 12 by a rotatably mounted fibrous brush 74 in contact therewith. A suitable brush cleaning device is described in U.S. Pat. No. 3,590,412 issued to Gerbasi in 1971.

It is believed that the foregoing description is sufficient for purposes of the present application to depict the general operation of a multi-color electrophotographic printing machine embodying the teachings of the present invention therein.

Figure 2:
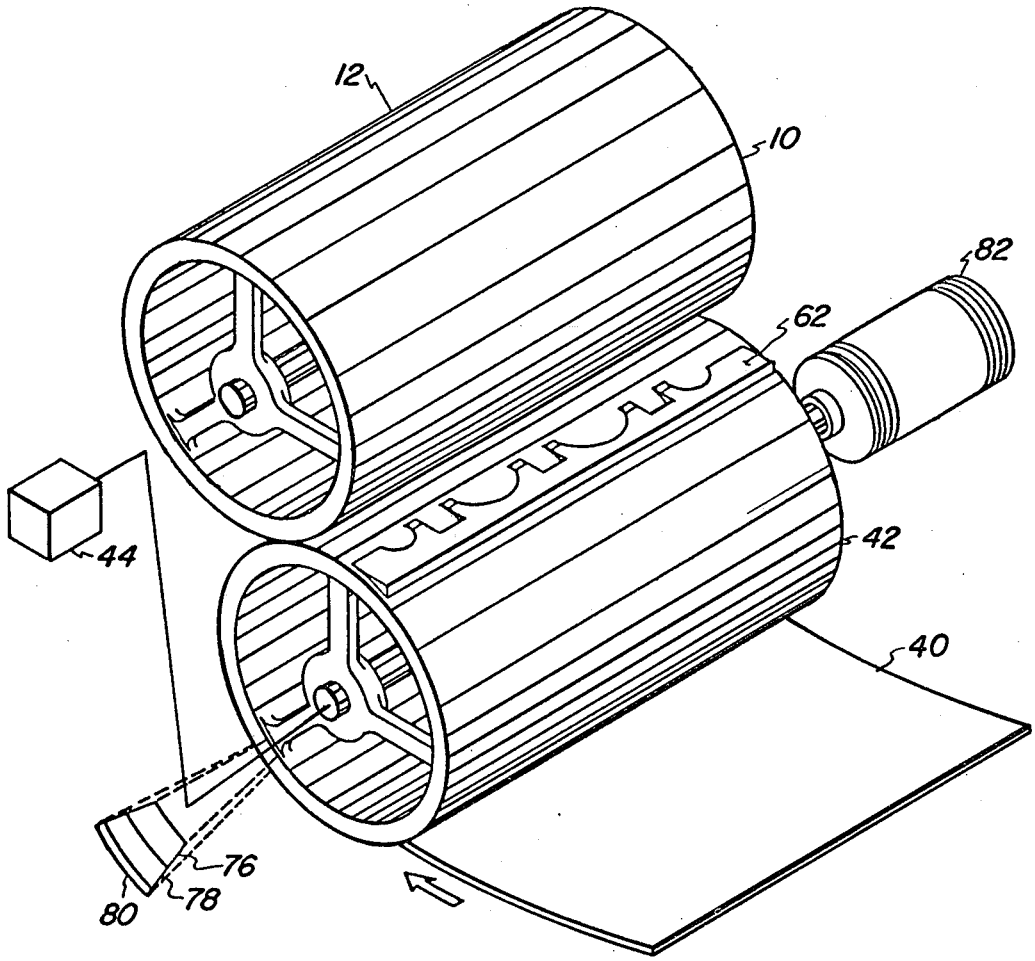
FIG. 2 is a schematic perspective view of the transfer apparatus employed in the FIG. 1 printing machine.

Referring now to the specific subject matter of the present invention, FIG. 2 depicts the transfer apparatus associated with photoconductive surface 12 of drum 10. Transfer roll 42 includes an aluminum tube 76, preferably having about a $\frac{1}{4}$ inch thick layer of urethane 78 cast thereabout. A polyurethane coating 80, preferably of about 1 mil thick, is sprayed over the layer of cast urethane 78. Preferably, transfer roll 42 has a durometer hardness ranging from about 10 units to about 30 units on the Shore A scale. The resistivity of transfer roll 42, preferably, ranges from about $10^8$ to about $10^{11}$ ohm-centimeters. Variable voltage source 44 applies a direct current bias voltage to aluminum tube 76 by suitable means such as a carbon brush and brass ring assembly (not shown). The voltage applied to roll 42 may range from about 1500 volts to about 6000 volts. This voltage may be adjusted for various layers of toner particles being transferred to support material 40. Thus, when the first layer of toner particles is transferred from transfer roll 42 to support material 40, the voltage applied thereto may be about 5000 volts, while a bias voltage applied for the transfer of the next successive layer of toner particles may be 4000 volts. Finally, when the third layer of toner particles is transferred to support material 40, the bias voltage may be 3000 volts. However, the bias voltage may also be maintained constant at a preferred value, i.e. 5000 volts. This depends upon the desired color correction being achieved by the system. The technique of color correction will be discussed further with reference to FIGS. 3 and 4. Transfer roll 42 is substantially the same diameter as drum 10 and is driven at substantially the same speed thereat. Contact between photoconductive surface 12 of drum 10 and transfer roll 42 with support material 40 interposed therebetween, is preferably, limited to a maximum of about 1.0 pound linear force. A synchronous speed main drive motor rotates transfer roll 42. This drive is coupled directly to transfer roll 42 by flexible metal bellows 82 which permits the lowering and raising of transfer roll 42. Synchronization of transfer roll 42 and drum 10 is achieved by precision gears (not shown) coupling the main drive motor to both transfer roll 42 and drum 10.

Figure 3:
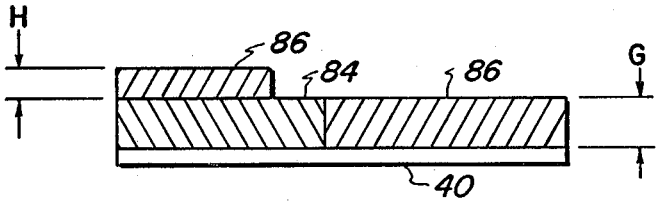
FIG. 3 is a graphic representation diagramatically depicting the characteristics typifying the transfer of two layers of toner particles by the FIG. 2 transfer apparatus.

Turning now to FIG. 3, there is shown support material 40 with a multi-layered toner powder image transferred thereto. When a layer of toner particles is deposited on the support material the effective resistivity of the transfer roll increases. Hence, if the voltage applied thereto remains constant, the magnitude of the electrostatic field applied to the toner particles adhering electrostatically to photoconductive surface 12 will decrease. Thus, the thickness of the toner particle layer transferred in superposition with the previous toner particle layer will be less than that of the previously transferred toner particle layer. This principle may be utilized to color correct copies produced on a multicolor electrophotographic printing machine. As hereinbefore indicated, toner particles having a cyan colorant contain a magenta colorant impurity. Similarly, toner particles having a magenta colorant contain a yellow colorant impurity. Thus, it is desirable to transfer less toner particles containing magenta colorant therein over toner particles containing cyan colorant therein. The foregoing is exemplified in FIG. 3. As shown therein, initially cyan toner particles 84 are transferred to the sheet of support material 40. Cyan toner particles 84 differ from ideal cyan toner particles in that they contain a magenta impurity. The thickness of the cyan toner particles may be represented by the letter G. Voltage source 44 maintains a constant potential on transfer roll 42. The next successive layer of toner particles contain a magenta colorant therein. Thus, magenta toner particles 86 are next transferred to support material 40 and in superposition with cyan toner particles 84. As shown in FIG. 3, when magenta toner particles 86 are transferred directly to support material 40 the thickness of the layer is substantially the same as that of cyan toner particles 84, i.e. a thickness of G. However, when magenta toner particles 86 are transferred to support material 40 in superposition with cyan toner particles 84 the thickness of the toner particle layer is less than that transferred to the bare sheet of support material 40. Thus, the magenta toner particles 86 are transferred over cyan toner particles 84 and have a thickness of H. As shown in FIG. 3, the thickness H of magenta toner particles 86 superimposed over cyan toner particles 84 is less than the thickness G of magenta toner particles 86 transferred directly to support material 40. The foregoing corrects for the impurities in the cyan colorant. Hence, the total color produced by magenta toner particles 86 superimposed with cyan toner particles 84 will contain substantially the correct amount of cyan colorant therein. This is due to the fact that the magenta toner particle layer 86 transferred over the cyan toner particle layer 84 is not as thick as the cyan toner particle layer. The magenta impurity in cyan toner particle layer 84 in combination with the layer of magenta toner particles 86 transferred thereto results in the total amount of magenta being approximately the ideal amount. The foregoing may also be achieved by adjusting the voltage produced from voltage source 44. By this it is meant that the voltage produced from voltage source 44 will be decreased for magenta toner particle transfer as compared to cyan toner particle transfer. However, one should note that it would also decrease the thickness of the layer of the magenta toner particles transferred directly to support material 40.

Figure 4:
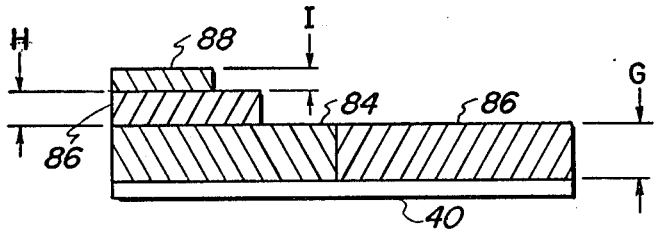
FIG. 4 is a graphic representation diagramatically illustrating the characteristics typifying the transfer of three layers of toner particles by the FIG. 2 transfer apparatus.

Turning now to FIG. 4, there is shown the effect of transferring three layers of toner particles in superposition with one another. FIG. 4 clearly illustrates the color correcting effect produced by maintaining voltage source 44 substantially constant. Once again, as shown in FIG. 4, cyan toner particle layer 84 is initially transferred to support material 40. The thickness of cyan toner particle layer 84 is represented by the letter G. Thereafter, magenta toner particles are transferred to support material 40 having cyan toner particles 84 adhering thereto. Magenta toner particles 86 are transferred directly to support material 40 and have a layer thickness of G and H. Thus, where the magenta toner particles are transferred directly to support material 40 they have the same thickness as the cyan toner particles 84, i.e. G. However, where magenta toner particles 86 are transferred in superposition with cyan toner particles 84, they have a thickness H. The thickness of the magenta toner particles 86 superimposed over the cyan toner particles 84 is less than that of the cyan toner particles. Hence, the magenta toner particles in combination with the magenta impurity contained in the cyan toner particles produce substantially the correct amount of magenta combination formed therebetween. If the thickness of the magenta toner particle layer 86 transferred over the cyan toner particle layer 84 were the same thickness as the cyan toner particle layer, the combined color formed thereby would have excessive magenta due to the magenta impurity contained in cyan toner particles 84. Finally, yellow toner particles 88 are transferred over magenta toner particles 86 superimposed over cyan toner particles 84. The thickness of the layer of yellow toner particles 88 is represented by the letter I. The thickness of the layer of yellow toner particles 88 is less than that of the magenta toner particle layer 86 and the cyan toner particle layer 84. Thus, it may be said that toner particle layer having a thickness I is less than the toner particle layer having a thickness H which in turn is less than the toner particle layer having a thickness G. The magenta toner particles 86 contain a yellow impurity. Thus, by decreasing the thickness of the yellow toner particle layer transferred in superposition with the magenta toner particle layer, the resultant combined color formed therebetween is color corrected. The foregoing process may be easily understood by the following. A layer of cyan toner particles 84 is transferred to support material 40. Thereafter, a thinner layer of magenta toner particles 86 are superimposed over the layer of cyan toner particles 84. However, the magenta colorant of the combined image is substantially correct inasmuch as cyan toner particles 84 contain a magenta impurity. Finally, a layer of yellow toner particles having still a lesser thickness are transferred in superposition over the layer of magenta toner particles. This corrects for the yellow impurity contained in the magenta toner particles. Thus, the resultant color formed from a combination of yellow, magenta and cyan is closely approximate to the ideal color, i.e. black. The foregoing color correction will not occur if the sequence of transfer is varied. Thus, in order to achieve substantial color correction initially, cyan toner particles must be transferred to the support material, thereafter, magenta toner particles, and finally, yellow toner particles. If the transfer sequence is varied, it may significantly increase the color errors rather than correcting therefore. Without color correction all colors reproduced may be desaturated i.e. dulled and grayish. For example, dulled cyan or blue, and dulled magenta becomes red. The extent of desaturation depends upon the transmission quality of the foregoing toner particles. The hereinbefore described transfer substantially minimizes color desaturation and optimizes the color copies to substantially correct for imperfections of the toner colorants. While in the preferred transfer sequence voltage source 44 is constant, it is evident that voltage source 44 may be adjusted so as to decrease the thickness of the yellow toner particle layer transferred over the previously transferred toner particle layer. However, this would produce a decrease in all of the yellow toner particles transferred thereto rather than a selective decrease in the thickness of the layer which is achieved by maintaining the voltage source 44 substantially constant.

In recapitulation, it is apparent that the transfer roll cooperating with the electrical biasing voltage source and the corresponding sequence of transfer operations minimizes the reproduction of desaturated colors. The method and apparatus heretofore described is adapted to correct for the impurities contained in the colorants employed in the toner particles utilized in the electrophotographic printing machine. This color correction automatically provides for high fidelity colors substantially approximating that of the original document.

It is, therefore, evident that there has been provided in accordance with the present invention a transfer apparatus and method of sequentially transferring successive layers of toner particles that fully satisfies the objects, aims and advantages set forth above. While this invention has been described in conjunction with specific embodiments thereof, it is apparent that many alternatives, modifications and variations will be evident to those skilled in the art. Accordingly, it is intended to embrace all alternatives, modifications and variations as fall within the spirit and broad scope of the appended claims.

What is claimed is:

1. A method of producing a color copy, including the steps of:

recording successive single color electrostatic latent images on an image bearing member;

developing each successive single color electrostatic latent image with particles containing a predetermined dominant colorant therein corresponding to each recorded single color electrostatic latent image, said step of developing comprising the steps of depositing particles containing a dominant cyan colorant with a minor magenta colorant impurity on an electrostatic latent image formed from a red filtered light image, depositing particles containing a dominant magenta colorant with a minor yellow impurity on an electrostatic latent image formed from a green filtered light image, and depositing particles containing a dominant yellow colorant on an electrostatic latent image formed from a blue filtered light image;

transferring successive layers of particles to a sheet of support material such that the layer of particles having the dominant magenta colorant with the minor yellow colorant is superimposed over the layer of particles having the dominant cyan colorant with the minor magenta colorant impurity and the layer of particles having the dominant yellow colorant is superimposed over both of the previously transferred layers of particles; and regulating electrically said transfer step so that successively thinner layers of particles are transferred from the image bearing member, to the sheet of support material resulting in a substantially color corrected copy.

2. A method as recited in claim 1, further including the step of fixing the transferred particles to the sheet of support material.

3. A method as recited in claim 1, wherein said step of recording includes the steps of:

creating a light image of the original document to be reproduced;

filtering the light image to create successive single color light images each containing a discrete color of the original document; and projecting successive single color light images onto a charged photoconductive image bearing member to record successive single color electrostatic latent images thereon.

* * * * *